US007331632B2

(12) United States Patent
Wendt

(10) Patent No.: US 7,331,632 B2
(45) Date of Patent: Feb. 19, 2008

(54) FOOTREST FOR WHEELCHAIRS OR THE LIKE

(75) Inventor: Roland Wendt, Isny (DE)

(73) Assignee: Aquatec GmbH, Isny (DE)

( * ) Notice: Subject to any disclaimer, the term of this patent is extended or adjusted under 35 U.S.C. 154(b) by 3 days.

(21) Appl. No.: 11/332,478

(22) Filed: Jan. 17, 2006

(65) Prior Publication Data

US 2006/0170183 A1 Aug. 3, 2006

(30) Foreign Application Priority Data

Jan. 14, 2005 (DE) ..... 10 2005 001 866

(51) Int. Cl.
*A47C 7/50* (2006.01)

(52) U.S. Cl. ..... 297/423.19; 297/423.25; 297/423.26; 297/423.23; 297/423.1; 280/304.1; 280/291

(58) Field of Classification Search ..... 297/423.19, 297/423.25, 423.37, 423.1, 423.26; 280/304.1, 280/291

See application file for complete search history.

(56) References Cited

U.S. PATENT DOCUMENTS 2,598,985 A 6/1952 Everest et al.
5,209,509 A * 5/1993 Gay et al. ..... 280/304.1
5,393,082 A 2/1995 Fenley
5,522,644 A 6/1996 Peek
5,957,474 A * 9/1999 Mundy et al. ..... 280/304.1
6,217,050 B1 * 4/2001 Dickie et al. ..... 280/291
6,352,307 B1 * 3/2002 Engman ..... 297/284.11
6,375,209 B1 4/2002 Schlangen
6,769,705 B1 * 8/2004 Schlangen ..... 280/250.1

FOREIGN PATENT DOCUMENTS

DE 102 43 309 A1 4/2004
GB 1110823 4/1968

* cited by examiner

*Primary Examiner*—David Dunn
*Assistant Examiner*—Erika Garrett
(74) *Attorney, Agent, or Firm*—RatnerPrestia

(57) ABSTRACT

A footrest for wheelchairs or the like comprises a foot plate (37) for the foot of a wheelchair patient, a supporting element for connection of the foot plate (37) to a wheelchair, and a bearing unit for supporting the foot plate (37) on the supporting element. The bearing unit, in turn, comprises a bearing body (36) that is in contact with the foot plate (37) and with the supporting element, a first bearing element (76) that pivotably connects the foot plate (37) to the bearing body (36), and a second bearing element (47) that pivotably connects the bearing body (36) to the supporting element.

13 Claims, 6 Drawing Sheets

FOOTREST FOR WHEELCHAIRS OR THE LIKE

Figure 1:
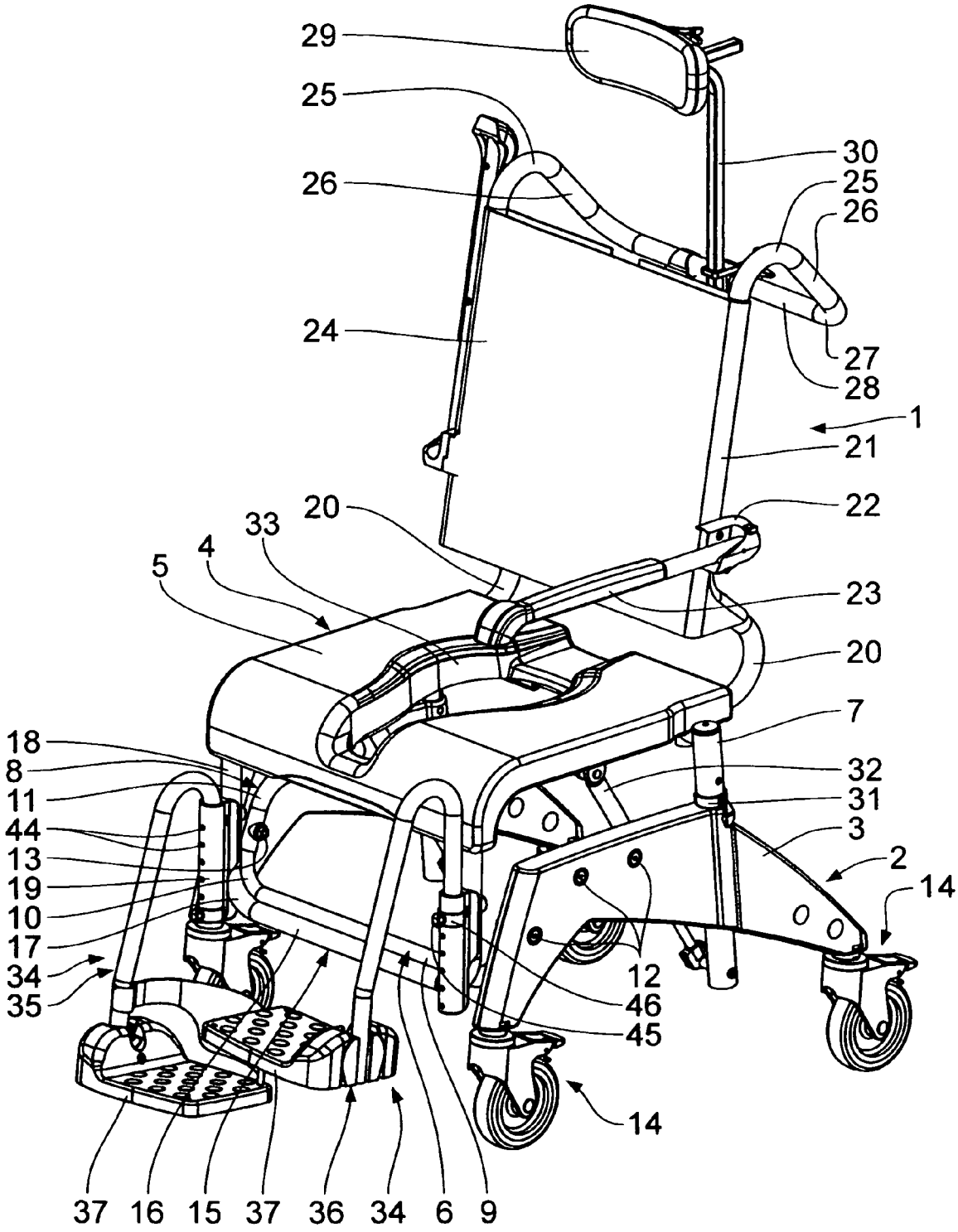

The invention is concerned with a footrest for wheelchairs that are suitable for patients, the elderly, or handicapped persons.

Most commonly, wheelchair footrests are mounted via their support tubes to the front of a wheelchair. Each footrest has a foot plate for the corresponding foot of a wheelchair patient, said foot plate being designed such that it can be pivoted up, to facilitate a wheelchair patient's access to his wheelchair. These foot plates can also be tilted toward the front and back in order to be adjusted according to the wheelchair patient's desires. The supporting mechanism of these types of footrests on the respective support tubes is extremely complicated.

With this as the starting point, the invention has as its object to improve a footrest for a wheelchair or the like in such a way that it can be optimally adapted, with respect to its position, to the wheelchair patient or wheelchair driver and that it additionally has an exceedingly simple design.

This object is met according to the invention in such a way that the footrest comprises

- a foot plate for the foot of a wheelchair patient,
- a supporting element for connection of the foot plate to a wheelchair, and
- a bearing unit for supporting the foot plate on the supporting element, said bearing unit comprising
  - a bearing body that is in contact with the foot plate and with the supporting element,
  - a first bearing element that pivotably connects the foot plate to the bearing body, and
  - a second bearing element that pivotably connects the bearing body to the supporting element.

The bearing unit, even though it is designed extremely simple, nonetheless allows for an optimally customized positioning of the foot plate. Because of the simple design of the footrest it can be manufactured extremely cost-effectively. Moreover, it is easy to install and clean.

The bearing body advantageously has a first bearing recess for the first bearing element. Additionally, the bearing body expediently has a second bearing recess for the second bearing element. A structural embodiment is characterized in that the first bearing recess and the second bearing recess extend substantially perpendicular to each other. The bearing body is provided for both, the first bearing element as well as the second bearing element, and permits an optimal adjustment of the position of the foot plate to the wheelchair patient.

The bearing body advantageously has a circumferential surface that has at least one curved bearing section and at least one straight contact section. It is highly advantageous if the foot plate has a bearing recess for receiving the bearing body, said bearing recess advantageously having a side wall incorporating at least one curved bearing section and at least one straight contact section. According to an advantageous embodiment, the foot plate is pivotable between two end positions relative to the bearing body; and in an end position of the foot plate a contact section of the bearing body advantageously rests against a contact section of the bearing recess, thus preventing the foot plate from being pivoted beyond its end position.

An additional advantageous embodiment is characterized in that the bearing body has a recess for the supporting element. In this manner a particularly good transfer of forces can be achieved between the bearing body and the supporting element.

The first bearing element is advantageously implemented as a threaded bolt for positioning the foot plate relative to the bearing body. This permits the foot plate to be moved into its desired position.

It is highly advantageous if also the second bearing element is implemented as a threaded bolt for positioning the bearing body relative to the supporting element. This allows the position of the bearing body to be adjusted.

Figure 2:
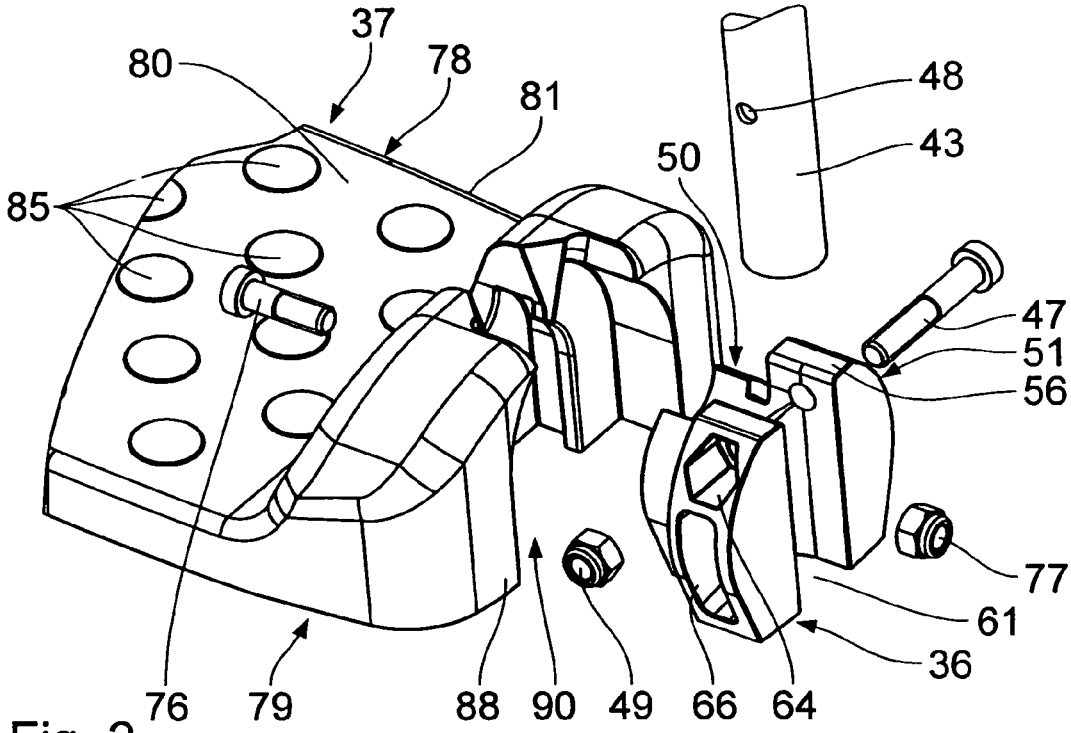
Figure 3:
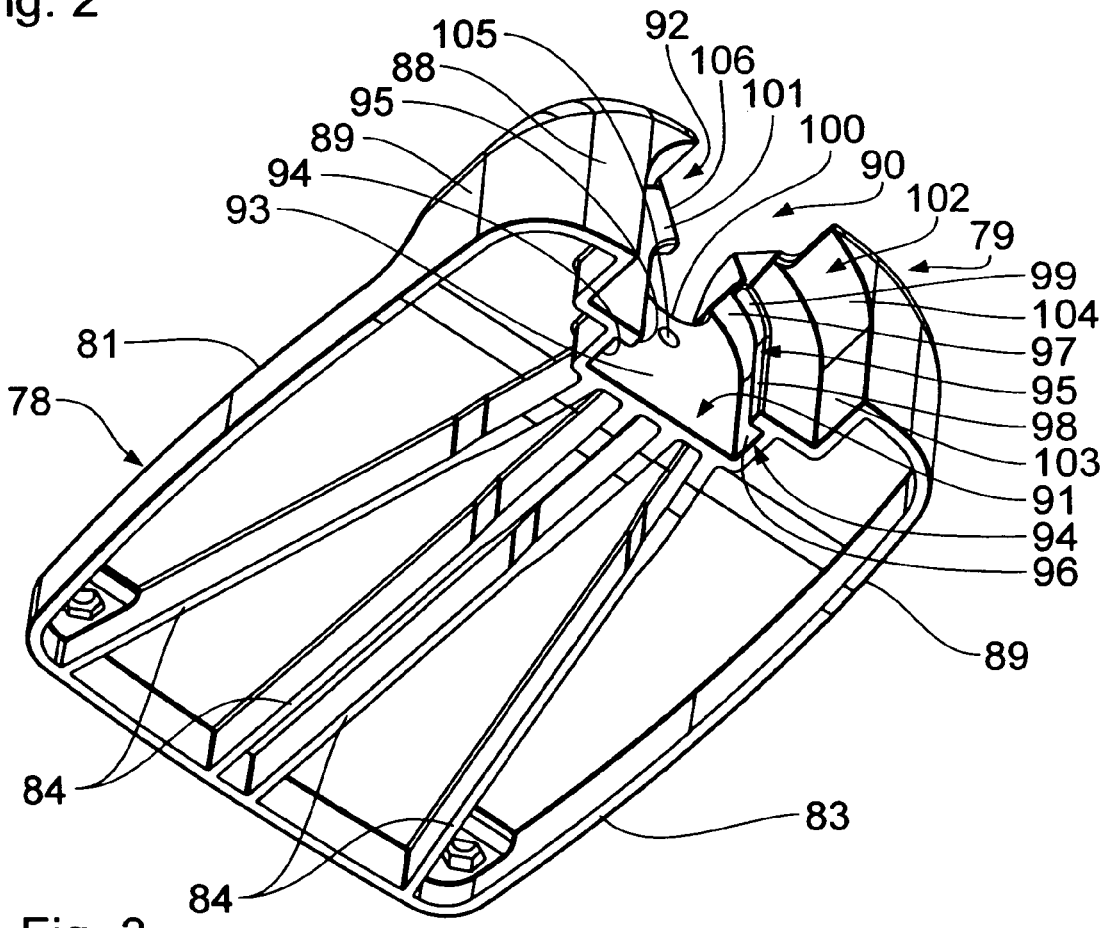
Figure 4:
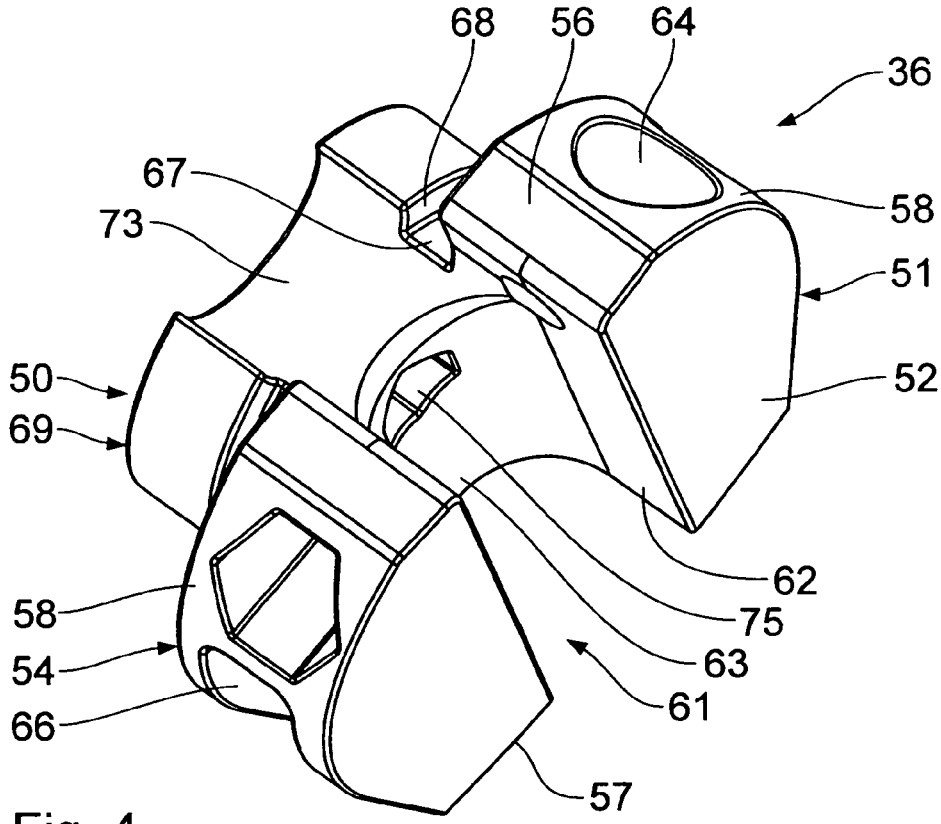
Figure 5:
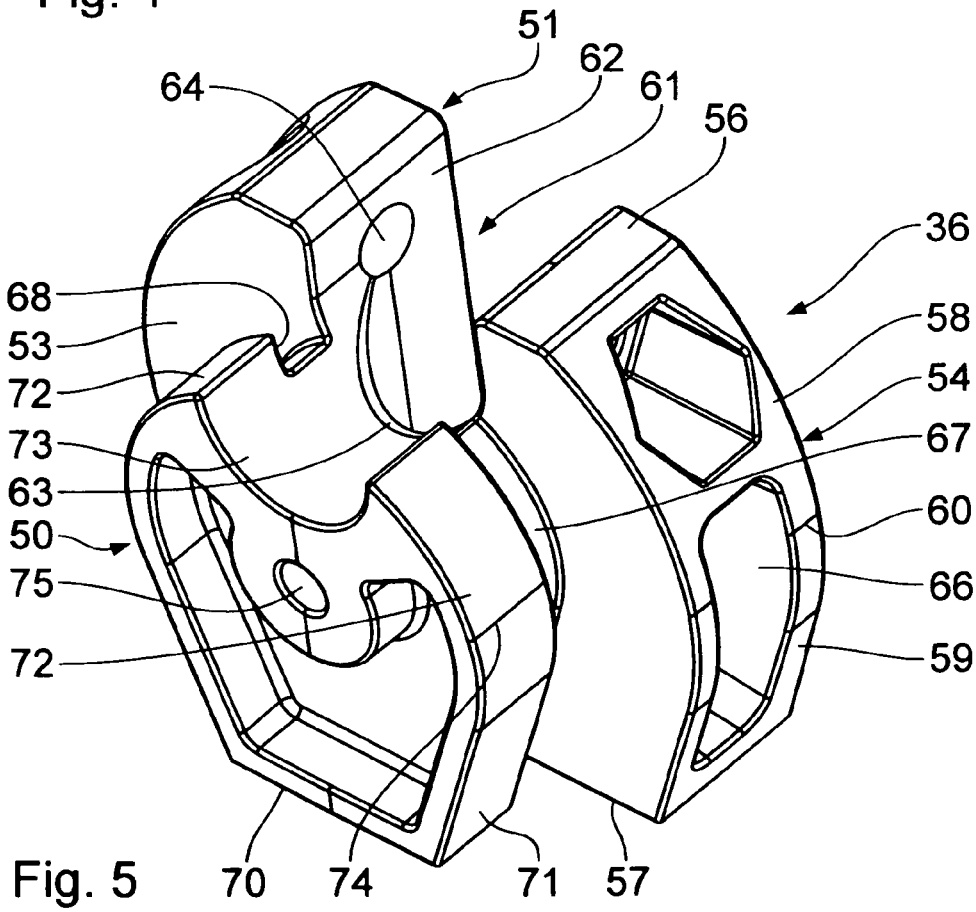
Figure 6:
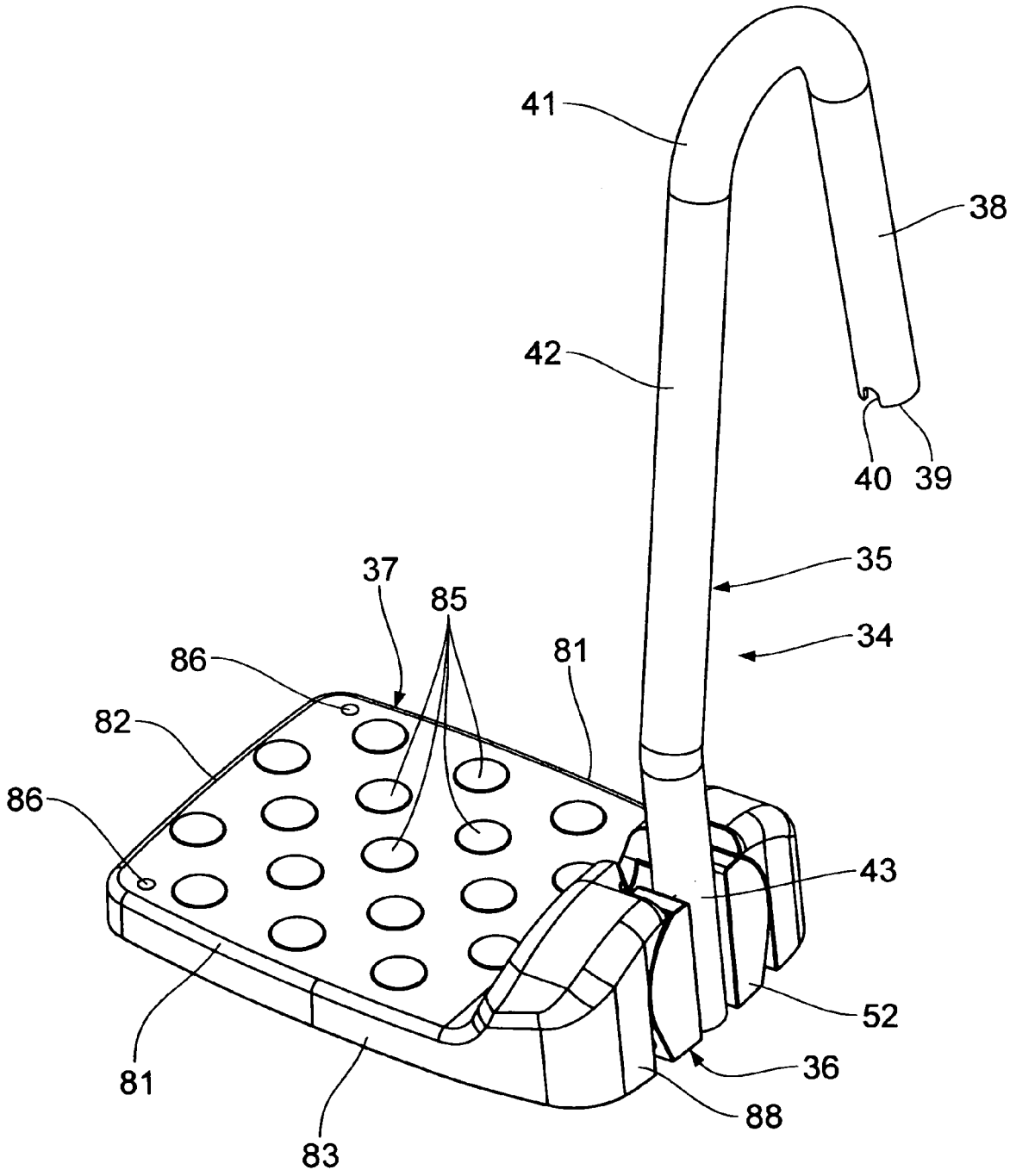
Figure 7:
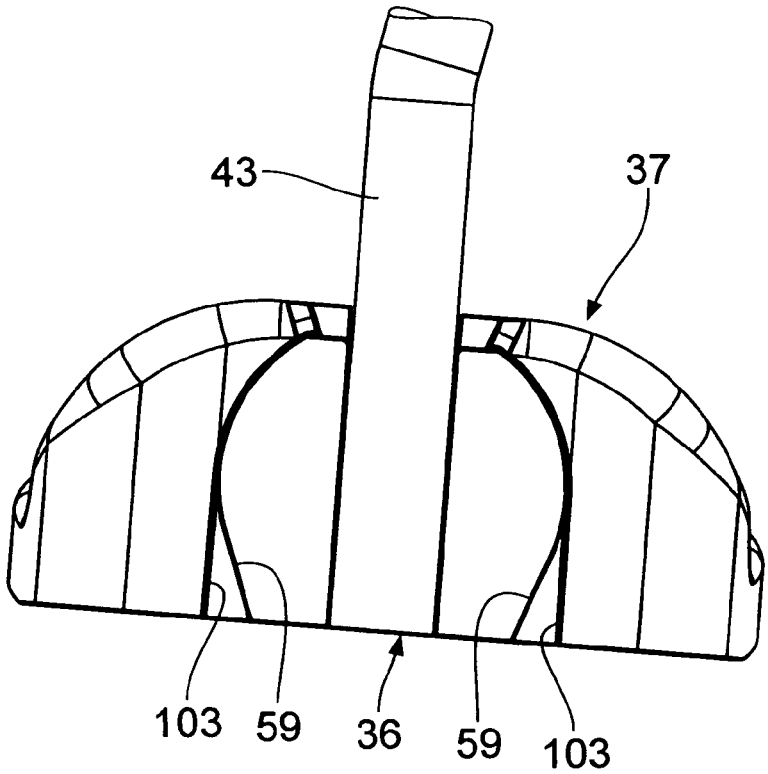
Figure 8:
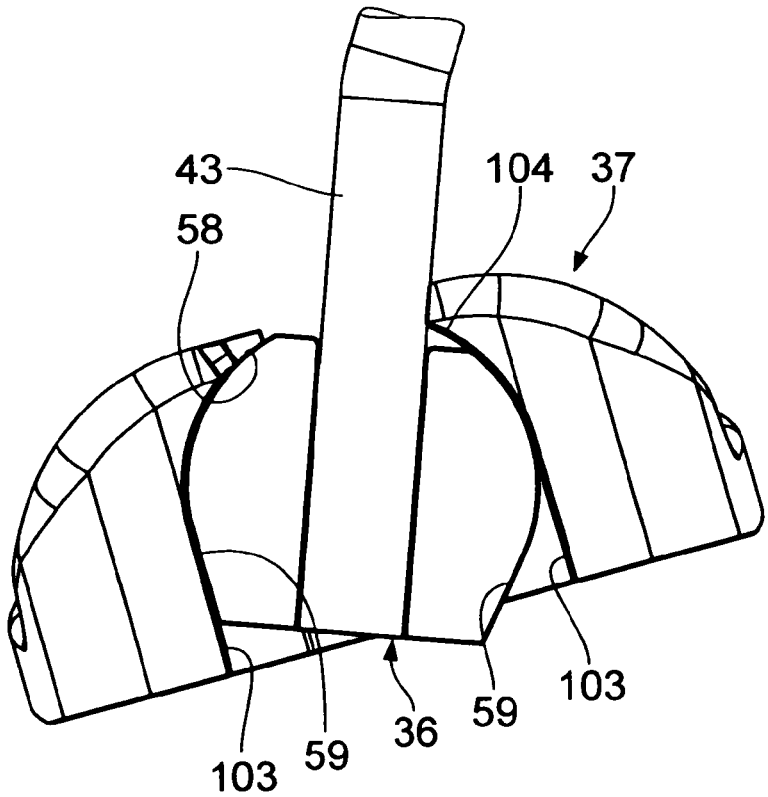
Figure 9:
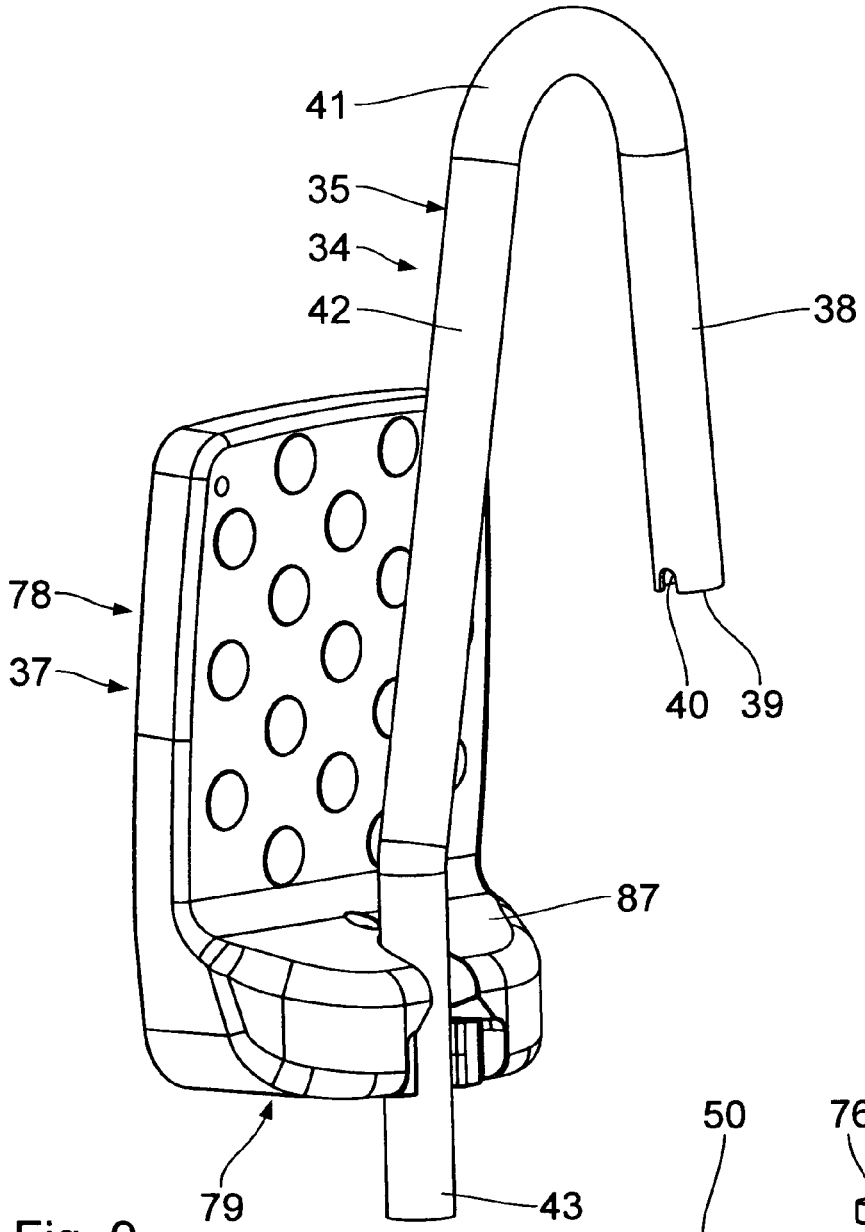
Figure 10:
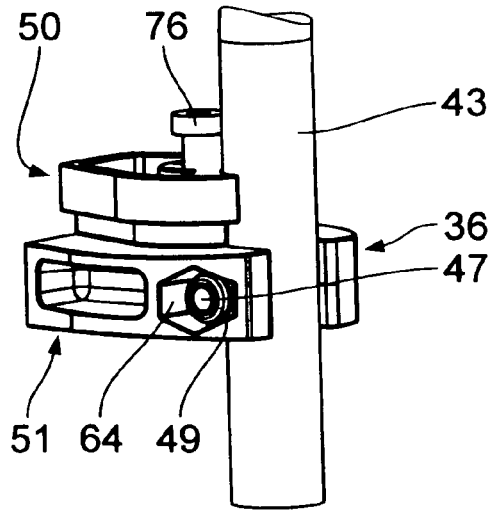

The invention will be described in more detail below based on a preferred embodiment in conjunction with the drawing, in which:

FIG. 1 shows a perspective view of a wheelchair, which is provided with two inventive footrests, FIG. 2 shows an exploded view, in an enlarged scale, of a footrest shown in FIG. 1, with the supporting element and the foot plate not shown in their entirety, FIG. 3 shows a perspective view of a foot plate of an inventive footrest from an angle from below, FIG. 4 shows a perspective view of a bearing body of the inventive footrest from a first side, FIG. 5 shows a perspective view of the bearing body shown in FIG. 4 from a second side, FIG. 6 shows a perspective view of an inventive footrest, with the foot plate located in its pivoted-down position, FIG. 7 shows a side view of a region of the footrest shown in FIG. 6, with the foot plate located in an intermediate pivot position, FIG. 8 shows a side view of a region of the footrest shown in FIG. 6, with the foot plate located in a pivot end position, FIG. 9 shows a perspective view of an inventive footrest, with the foot plate located in its folded-up position, and FIG. 10 shows a perspective view of a bearing body mounted on a supporting element, with the bearing body located in its folded-up position.

A shower or commode wheelchair 1 shown in FIG. 1 for patients, the elderly, or handicapped persons, comprises a basic frame 2 consisting of two plastic side parts 3 and a seat 4 having a seating surface 5, said seat 4 being supported relative to the basic frame 2 via a tube framework 6 and two rear support tubes 7. The seat 4 provided for a wheelchair patient is permeated by a longitudinal opening 33, which facilitates, for example, washing of the patient. Supported on each side part 3 are a front and a rear roller support member 14, both of which are rotatable about a substantially vertical axis of rotation. Each roller support member 14 carries a rotationally supported roller 15 that permits the wheelchair 1 to be pushed along a floor. The rollers 15 support the side parts 3 relative to a floor.

The framework 6 comprises a first, one-piece, symmetrical tube member 8 that is situated between the two side parts 3 and arranges same at a distance from each other. The tube member 8 has a horizontally extending spacer section 9, an angle piece 10 adjoining each of its two ends. Provided in direct connection with each angle piece 10 is a fastening section 11, which extends on the inside along a partial region of the corresponding side part 3. The fastening sections 11 extend through the angle pieces 10 from the horizontal spacer section 9 upwardly toward the rear, and are screwed to the two side parts 3. Provided for this are altogether six fastening screws 12 and six corresponding fastening nuts 13.

The framework 6 additionally has a second, one-piece, symmetrical tube member 15 that is in direct connection with the seat 4. The tube member 15 comprises a horizontally extending connecting section 16 that extends parallel to the spacer section 9 of the tube member 8. Adjoining the connecting section 16 at each end is an angle piece 17. Directly connected to each angle piece 17 is a supporting section 18 that extends substantially perpendicular to the connecting section 16 and carries on its front a receptacle 19 having a circular receptacle recess. Adjoining each supporting section 18, in turn, is a mounting surface section substantially perpendicular to the former that extends underneath the seat 4 and supports it. Each mounting surface section transitions via a curved section 20 into a backrest-supporting section 21, to which a bearing body 22 for an armrest 23 is mounted as well. The bearing body 22 permits the armrest 23 to be pivoted between a substantially horizontal (see FIG. 1) and vertical pivot position. The backrest-supporting sections 21, according to FIG. 1, are tilted slightly toward the rear relative to a vertical position. Disposed between the two backrest-supporting sections 21 is a backrest 24 that provides a resting surface for the back of a wheelchair patient. Adjoining the backrest-supporting sections 21, in each case, is a U-shaped curved section 25, which—with reference to FIG. 1—transitions into a downwardly rearwardly inclined first handle section 26. Adjoining each first handle section 26, in turn, is an angle piece 27. Extending between the two angle pieces 27 of the second tube member 15 is a substantially horizontal second handle section 28. The handle sections 26, 28, ensure that the wheelchair 1 can be pushed conveniently and safely. Mounted to the handle section 28 by means of a support tube 30, is a headrest 29.

The tube member 15 is hinged in the region of its mounting surface sections to the support tubes 7, which are guided displaceably in corresponding recesses of the side parts 3. By displacing the support tubes 7, the tube member 15 with the receptacles 19, the seat 4, and the backrest 24 can be height-adjusted together. A locking element 31 permits the position of a support tube 7 to be locked relative to a side part 3. By hinging the tube member 15 to the support tubes 7 in the rearward region of the mounting surface sections, the tube member 15 with the receptacles 19, the seat 4, and the backrest 24 are rendered pivotable toward the back from the position shown in FIG. 1. The corresponding pivot axis extends below the seat 4. Hinged to each mounting surface section and to a lower end section of the adjacent support tube 7 in each case is a gas spring 32 to enhance the pivot movement. As viewed from the connection between the tube member 15 and the support tubes 7, the gas spring 32 is hinged to the mounting surface sections further toward the front. The two gas springs 32 can be actuated by means of an operating lever that is mounted on the handle section 28 and connected to the gas springs 32 by means of Bowden wires.

The receptacles 19 that are in contact with the tube member 15 are provided for mounting a left and a right footrest 34. The footrests 34 are designed identical. A footrest 34 and its individual parts will be described in more detail below, also under reference to the appended FIGS. 2 through 10.

The footrest 34 comprises a one-piece support tube 35 of stainless steel, to which a plastic foot plate 37 is connected via a one-piece plastic bearing body 36. The foot plate 37 is also designed as one piece. It is provided for the foot of a wheelchair patient.

The support tube 35, which is circular-ring shaped in cross section, incorporates a straight insertion section 38, the outside diameter of which corresponds approximately to the diameter of the receptacle recess of the receptacle 19. The length of the insertion section 38 corresponds approximately to the depth of the receptacle recess. Disposed in the region adjacent to the free end 39 of the insertion section 38 is an alignment recess 40, which is U-shaped and open toward the bottom. The insertion section 38 serves for insertion into the receptacle recess of the receptacle 19. It, and the footrest 34, is held pivotable in the receptacle recess about a substantially vertical pivot axis. Provided in the front of the receptacle 19 are a plurality of positioning openings 44 that are arranged above one another, into which the shank of a steel bolt 45 can be inserted. The diameter of the shank of the steel bolt 45 corresponds approximately to the opening width of an alignment recess 40, so that in the assembled condition of a footrest 34 on the wheelchair 1, the shank of the steel bolt 45 can be at least partially seated in the alignment recess 40. This engagement prevents an unintended pivoting of the footrest 34 from the transport position shown in FIG. 1. To pivot the footrest 34, the insertion section 38 must be slightly lifted, so that the steel bolt 45 and the alignment recess 40 are moved out of engagement. The steel bolt 45 is embedded in a plastic bracket 46 that keeps the steel bolt 45 at the receptacle 19 inside the corresponding positioning opening 44. The height of the foot plate 37 is selectable by selecting a positioning opening 44.

Adjoining the end of the insertion section 38 opposite its free end 39 is a curved section 31, which transitions into a connecting section 42 that extends—relative to the above transport position of the footrest 34—in a frontally downwardly inclined direction. Adjoining the connecting section 42, in turn, is a straight bearing section 43 that extends substantially vertically. Fastened in the region of the bearing section 43 is the bearing body 36. The bearing body 36 is mounted on the support tube 35 by means of a threaded bolt 47, a recess 48 formed in the bearing section 43 of the support tube 35, and a corresponding nut 49. The recess 48 extends substantially horizontally and has two opposed circular openings.

The bearing body 36 comprises an inner part 50, and an outer part 51 that is connected to the inner part 50. The outer part 51 has two opposed, flat front faces that are parallel to each other, namely an outer front face 52 and an inner front face 53 facing the inner part 50, as well as a circumferential surface 54 perpendicular to them. With reference to FIGS. 2, 4 and 5, the circumferential surface 54 has a straight top section 56 and a straight bottom section 57 that is parallel to the top section 56. Adjoining the top section 56 are bearing sections 58 that have an outward curvature and that transition into straight contact sections 59. The contact sections 59 adjoin the bottom section 57. Starting from the top section 56, the outer section 51 widens in the region of the bearing sections 58 up to the corresponding inflection lines 60, after which it narrows up to the contact sections 59. The inflection lines 60 extend in the bearing sections 58. In the region of the contact sections 59 the outer part 51 evenly narrows toward the bottom section 57.

Extending centrically in the outer part 51, relative to the width of the outer part 51, is a continuous longitudinal recess 61, the width and depth of which correspond approximately to the outside diameter of the bearing section 43 of the support tube 35. The longitudinal recess 61 extends through the top section 56 and through the bottom section 57, i.e., it is open toward the top and bottom. Additionally, the longitudinal recess 61 is open toward the outer front face 52 of the outer part 51. It is delimited by two opposed, parallel, straight limit walls 62 and a connecting wall 63 that connects the limit walls 62 to each other. The connecting wall 63 is curved toward the inner part 50.

Also extending through the outer part 51 is a bearing recess 64, which is situated above the inflection lines 60 in the bearing sections 58. The bearing recess 64 extends perpendicular to the longitudinal recess 61 and has, along a first section that extends from the circumferential surface 54 to one limit wall 62 of the longitudinal recess 61, a circular cross section (see FIG. 4, on the right). In the region of the circumferential surface 54 the diameter of this first section corresponds approximately to the diameter of the head of the threaded bolt 47, whereas in the region of the limit wall 62 the diameter of this first section corresponds approximately to the diameter of the shank of the threaded bolt 47. The region of this first section adjacent to the circumferential surface 54 is provided to receive the head of the threaded bolt 47, whereas the section adjacent to the limit wall 62 is designed for the shank of the threaded bolt 47. Along a second section, the bearing recess 64 has a hexagonal cross section (see FIG. 4, on the left). This second section extends from the other limit wall 62 to the circumferential surface 54. The cross section of the second section of the bearing recess 64 corresponds approximately to the outer shape of the nut 49. The nut 49 may be accommodated in a form-fitting manner in the second section of the bearing recess 64. Disposed below the bearing recess 64 are two opposed, oblong recesses 66, which are open only toward the circumferential surface 54. Each recess 66 extends from a bearing section 58 into a contact section 59.

The inner part 50 is connected by means of a neck part 67 to the outer part 51 and protrudes relative to the neck part 67 by a contact shoulder 68 that extends substantially parallel to the front faces 52, 53. The neck part 67 is offset inward relative to the bearing sections 58, contact sections 59 and top section 56 of the outer part 51. The basic shape of the inner part 50 corresponds approximately to the basic shape of the outer part 51. The width, thickness and height of the inner part 50, however, is smaller than the width, thickness and height of the outer part 51. The inner part 50 has a circumferential surface 69 that incorporates a straight bottom section 70, adjoining which, on both sides, is a straight contact section 71. The contact sections 71 transition into curved bearing sections 72. The bearing sections 72 are curved outward. Disposed in-between the two bearing sections 72 is an upwardly open, inwardly curved section 73, the curvature radius of which corresponds approximately to the radius of the bearing section 43 of the support tube 35 and to the width of the longitudinal recess 61. The inner part 50 continuously widens in the region of the contact sections 71, starting from the lower section 70, up to the bearing sections 72. In the region of the bearing sections 72, the inner part 50 then widens up to the corresponding inflection lines 74; the inner part 50 subsequently narrows up to the curved section 73. A contact section 71 of the inner part 50 extends approximately parallel to the corresponding contact section 59 of the outer part 51. The curvature of the bearing sections 72 of the inner part 50 corresponds approximately to the curvature of the bearing sections 58 of the outer part 51.

The inner part 50 additionally has a centrical—relative to the width of the bearing body 36—continuous bearing recess 75 extending perpendicular to the longitudinal recess 61 and bearing recess 64. The bearing recess 75 extends below the bearing recess 64. It is open at the end in each case and opens into the longitudinal recess 61. In the region of the inner part 50, the bearing recess 75 is circular. In the region of the neck part 67, however, the bearing recess 75 has a hexagonal shape.

The bearing body 36 has a symmetrical basic shape relative to a plane bisecting the inner part 50 and the outer part 51. This plane extends centrically through the longitudinal recess 61, as well as through the bearing recess 75 and is perpendicular to the bearing recess 64. In FIG. 5 it extends substantially vertically.

The foot plate 37 is screwed to the bearing body 36. Provided for this is a threaded bolt 76 and a corresponding nut 77. The circular region of the bearing recess 75 has a diameter that corresponds approximately to the diameter of the shank of the threaded bolt 76. This region of the bearing recess 75 is provided to receive the shank of the threaded bolt 76. The shape and dimensions of the hexagonal region of the bearing recess 75, on the other hand, are adapted to the nut 77, which can be accommodated there in a form-fitting manner.

The foot plate 37 comprises a foot support part 78 for the foot of a wheelchair patient, and a bearing part 79, which laterally adjoins the foot support part 78. The foot support part 78 has a flat foot support plate 80, around which a frame 83 extends along its two longitudinal edges 81 and its free transverse edge 82. The frame 83 extends downward from the foot support plate 80. Four reinforcement braces 84 also project downward from the foot support plate 80. Disposed on the upper side of the foot support plate 80 is a plurality of round anti-slip projections 85 that protrude from the foot support plate 80. Disposed in the corner regions of the foot support plate 80 formed by the longitudinal edges 81 and the free cross edge 82 are two fastening recesses 86 that extend through the foot support plate 80 from the top down. To be inserted into one fastening recess 86 of a foot plate 37, in each case, is an end section of a threaded bolt for attaching a back wall. The back wall is additionally fastened to the bearing section 43 and prevents the wheelchair patient's foot from slipping off the foot support plate 80 toward the back.

The bearing part 79 of the foot plate 37 is raised relative to the foot support part 78. It has a side face 87 facing the foot support part 78, a side face 88 opposite the side face 87, and two side faces 89 connecting the side faces 87, 88. The bearing part 79 has formed in it a bearing recess 90, which is open toward the top and bottom, as well as toward the outside. The bearing recess 90 comprises an inner bearing region 91 for the inner part 50 and an outer bearing region 92 for the outer part 51. The inner bearing region 91 is situated closer to the foot support part 78 than the outer bearing region 92. The inner bearing region 91 is formed by a side wall 93, two side walls 94 extending perpendicularly from the former, and two holding projections 95 projecting inward from the side walls 94 and extending parallel to the side wall 93. The side wall 93 is designed flat and extends approximately perpendicular to the foot support plate 80. The side walls 94 in each case have a lower, straight contact section 96 that extend parallel to each other. Adjoining each contact section 96 is an outwardly curved bearing section 97. The curvature of a bearing section 97 is substantially adapted to the curvature of a bearing section 72 of the inner part 50 of the bearing body 36. The interior spacing of the side walls 94 of the inner bearing region 91 relative to each other corresponds approximately to the width of the inner part 50 of the bearing body 36 in the region of the inflection lines 74, i.e., the spacing of the side walls 94 relative to each other corresponds approximately to the largest width dimension of the inner part 50. The holding projections 95 are adapted correspondingly to the neck part 67 of the bearing body 36. The profile of a holding projection 95 corresponds approximately to the profile of the side wall 94, i.e., it, too, has a straight lower section 98 and a curved section 99.

The inner bearing region 91 is completely open at the bottom. Additionally, the inner bearing region 91 has at its top an opening that extends between the bearing sections 97.

The bottom opening of the inner bearing region 91 has a larger opening width than the top opening. In the region of the top opening, the side wall 93 has an evenly inwardly curved recess 100, the curvature radius of which corresponds approximately to the radius of the bearing section 43 of the support tube 35. Adjoining each holding projection 95 is a contact wall 101 that extends parallel to the side wall 93 and has an approximately constant width. The recess 100 in each case separates the bearing sections 97, the curved sections 99 of the holding projections 95, and the upper, immediately adjacent sections of the contact walls 101. Adjoining each contact wall 101 is a side wall 102 that is situated perpendicular on the contact wall 101 and that transitions into the side face 88. Each side wall 102 also has a lower, straight contact section 103 and an upper curved bearing section 104. The contact sections 103 of the side walls 102 extend parallel to each other. The side walls 102 and the contact walls 101 with the holding projections 95 are substantially adapted to the basic shape of the outer part 51 of the bearing body 36. The curvature of a bearing section 104 corresponds approximately to the curvature of a bearing section 58 of the outer part 51 of the bearing body 36. The width of a side wall 102 corresponds approximately to the width of the circumferential surface 54 of the outer part 51.

The side wall 93 and the side face 87 of the foot plate 37 are penetrated by a bearing recess 105 that extends parallel to the foot support plate 80 and that is designed circular. The bearing recess 105 is arranged centrical, relative to the width of the side wall 93. The diameter of the bearing recess 105 corresponds approximately to the diameter of the shank of the threaded bolt 76.

The foot plate 37 is symmetrical relative to a plane extending centrically through the bearing recess 90 and bearing recess 105 and situated perpendicular on the foot support plate 80.

As mentioned above, the support tube 35 is screwed to the bearing body 36. For this purpose the shank of the threaded bolt 47 penetrates the bearing recess 64 in the bearing body 36 and the recess 48 in the support tube 35. The shank of the threaded bolt 47 is in threaded engagement with the nut 49 that is situated in the correspondingly designed section of the bearing recess 64. In this section the nut 49 cannot rotate relative to the bearing body 36. The bearing body 36 is pivotable on the support tube 35 about the shank of the threaded bolt 47. The threaded bolt 47 thus forms a bearing element for the pivotable support of the bearing body 36 and foot plate 37 on the support tube 35. The pivoting takes place about the longitudinal center axis of the threaded bolt 47 which, according to FIG. 1, extends substantially horizontally.

The bearing body 36 is disposed in the bearing recess 90 of the foot plate 37. The outer front face 52 of the bearing body 36 is flush, in the horizontal position of the foot plate 37, with the side face 88 of the foot plate 37. The inner part 50 of the bearing body 36 is situated in the inner bearing region 91 of the foot plate 37, whereas the outer part 51 is disposed in the outer bearing region 92. The sections 58, 59 of the bearing body 36 face the side walls 102 of the foot plate 37, partly contacting them, whereas the sections 71, 72 of the bearing body 36 face the side walls 94 partly resting against them. The projections 95 engage in the bearing body 36 in the region of the neck part 67 and prevent the bearing body 36 from moving toward the inside or toward the outside in the bearing recess 90. The contact walls 101 are in contact with the front face 53.

The shank of the threaded bolt 76 extends through the bearing recess 105 of the foot plate 37 and the bearing recess 75 of the bearing body 36. The threaded bolt 76 is in threaded engagement with the nut 77, which is situated in the correspondingly designed section of the bearing recess 75. The nut 77 cannot rotate relative to the bearing body 36. The threaded bolt 76 forms a bearing element for the pivotable support of the foot plate 37 on the bearing body 36. The pivoting takes place about the longitudinal center axis of the threaded bolt 76, which extends substantially horizontally.

The following is a more detailed description of the function of the footrest 34 and the interaction of the individual parts of the footrest 34. The foot plate 37 is pivotable between a folded-down, horizontal position shown in FIG. 1 and FIG. 6, on one hand, and a folded-up, vertical position shown in FIG. 9, on the other hand. This upward and downward pivot movement takes place about the shank of the threaded bolt 47 which, according to FIG. 1, extends in a substantially horizontal plane. The moment required for the pivoting action is adjustable via the tightening moment of the threaded bolt 47. By an appropriate tightening of the threaded bolt 47, the bearing body 36 and with it also the foot plate 37 can be locked in any desired pivot position. In the tightened condition the nut 49 presses against the support tube 35. The bearing body 36, in the process, is wedged against the support tube 35. Since the nut 49 is not rotatable inside the bearing recess 64, the nut 49 does not need to be held separately when tightening the threaded bolt 47. It is preferred that the foot plate 37 is secured in place in such a way that it remains movable by exerting a corresponding actuation moment onto the foot plate 37. This actuation moment is adjustable through tightening of the threaded bolt 47.

In the folded-down pivot position of the foot plate 37, an end section of the bearing section 43 extends inside the longitudinal recess 61 of the bearing body 36. The end section extends over the entire length of the longitudinal recess 61. This means there is contact over a large surface between the limit walls 62 and the end section of the bearing section 43. The diameter of the bearing section 43 of the support tube 35 and the depth of the longitudinal recess 61 of the bearing body 36 is—as mentioned above—selected such that the bearing section 43 does not laterally protrude from the bearing body 36. In the pivoted-up position of the foot plate 37 a region of the bearing section 43 is situated in the correspondingly designed curved section 73 of the bearing body 36. The curved section 73 permits the foot plate 37 to be folded up nearly vertical and forms a limit stop delimiting the pivot movement.

The foot plate 37 is additionally pivotable about an additional pivot axis, which is formed by the shank of the threaded bolt 76. This ability to pivot is illustrated best in FIGS. 7 and 8. With respect to FIG. 1, a pivoting of the foot plates 37 is possible toward the front and back. The bearing sections 58 and 72 of the bearing body 36, in the process, guide the foot plate 37 over their correspondingly adapted bearing sections 97, 104. Shown in FIG. 8 is an end position of the foot plate 37. In an end position of the foot plate 37, the corresponding contact sections 59, 71 of the bearing body 36 rest with a flat surface against the corresponding contact sections 96, 103 of the foot plate 37. The actuation moment for pivoting the foot plate 37 can be adjusted here as well via the tightening moment of the threaded bolt 76. Locking it in any desired pivot position is also possible via a corresponding tightening of the threaded bolt 76. In the locked position the bearing body 36 and the foot plate 37 are pressed together by the head of the threaded bolt 76 and the nut 77. The foot plate 37 is thus wedged against the bearing body 36. Due to the corresponding design of the bearing recess 75, the nut 77 does not need to be held when tightening the threaded bolt 76.

The bearing recess 90 has on its top an inlet slope 106, so that folding up the foot plate 37 is possible in all forward and backward pivoted positions.

The foot plate 37 is thus pivotable by means of the bearing unit about two pivot axes extending perpendicular to each other and horizontally. This permits an optimal adjustment of the foot plate 37 to a wheelchair patient.

In lieu of the utilized nuts 49, 77, it is also possible to implement corresponding threads directly in the bearing body 36.

What is claimed is:

1. A footrest for wheelchairs, comprising:

a foot plate (37) for the foot of a wheelchair patient;

a supporting element (35) for connection of the foot plate (37) to a wheelchair (1); and a bearing unit for supporting the foot plate (37) on the supporting element (35), said bearing unit comprising a bearing body (36);

wherein said bearing body (36) is pivotably connected to said supporting element (35) so that it can pivot with respect to said supporting element (35) in a first plane;

wherein said foot plate (37) is pivotably connected to said bearing body (36) so that said foot plate (37) can pivot with respect to said bearing body (36) in a second plane, said second plane being different in direction from said first plane;

wherein said foot plate (37) has a bearing recess (90) receiving the bearing body (36) and comprising side walls (94, 102); and wherein said bearing body has a circumferential surface (54, 69) having at least one curved bearing section (58, 72) being in contact with said side walls (94, 102) of said bearing recess (90) to allow pivoting of said foot plate (37) with respect to said bearing body (36) in said second plane and at least one straight contact section (59, 71) adapted to get in contact with a portion of said side walls (94, 102) to define an end position of the pivoting of said foot plate (37) with respect to said bearing body (36).

2. A footrest according to claim 1, wherein the bearing unit further comprises a first bearing element (76) that pivotably connects the foot plate to the bearing body (36) and wherein the bearing body (36) has a first bearing recess (75) for the first bearing element (76).

3. A footrest according to claim 2, wherein the bearing unit further comprises a second bearing element (47) and wherein the bearing body (36) has a second bearing recess (64) for the second bearing element (47).

4. A footrest according to claim 3, wherein the first bearing recess (75) and the second bearing recess (64) extend substantially parallel to each other.

5. A footrest according to claim 3, wherein the second bearing element (47) is implemented as a threaded bolt for positioning the bearing body (36) relative to the supporting element (35).

6. A footrest according to claim 3, wherein the first bearing recess (75) and the second bearing recess (64) extend substantially parallel to each other.

7. A footrest according to claim 2, wherein the first bearing element (76) is implemented as a threaded bolt for positioning the foot plate (37) relative to the bearing body (36).

8. A footrest according to claim 1, wherein said side walls (94, 102) each have at least one curved bearing section (97, 104) and at least one straight contact section (96, 103).

9. A footrest according to claim 8, wherein in one end position of the foot plate (37) the at least one straight contact section (59, 71) of the bearing body (36) rests against a contact section (96, 103) of the bearing recess, thus preventing a pivoting of the foot plate (37) beyond its end position.

10. A footrest according to claim 1, wherein the foot plate (37) is pivotable between two end positions relative to the bearing body (90).

11. A footrest according to claim 10, wherein in one end position of the foot plate (37) the at least one straight contact section (59, 71) of the bearing body (36) rests against a contact section (96, 103) of the bearing recess, thus preventing a pivoting of the foot plate (37) beyond its end position.

12. A footrest according to claim 1, wherein the bearing body (36) has a recess (61) for the supporting element (35).

13. A footrest according to claim 1, wherein in one end position of the foot plate (37) the at least one straight contact section (59, 71) of the bearing body (36) rests against a contact section (96, 103) of the bearing recess, thus preventing a pivoting of the foot plate (37) beyond its end position.

* * * * *